US006343893B1

(12) United States Patent
Gleditsch

(10) Patent No.: US 6,343,893 B1
(45) Date of Patent: Feb. 5, 2002

(54) ARRANGEMENT FOR CONTROLLING FLOATING DRILLING AND INTERVENTION VESSELS

(75) Inventor: Svein Gleditsch, Harstad (NO)

(73) Assignee: Mercur Slimhole Drilling and Intervention AS, Sandnes (NO)

( * ) Notice: Subject to any disclaimer, the term of this patent is extended or adjusted under 35 U.S.C. 154(b) by 0 days.

(21) Appl. No.: 09/470,186

(22) Filed: Nov. 29, 1999

(51) Int. Cl.[7] ..... B63B 35/44; E21B 41/04

(52) U.S. Cl. ..... 405/196; 405/224.4; 166/355; 114/264

(58) Field of Search ..... 166/355; 405/195.1, 405/196, 221, 224, 224.2, 224.4; 114/264

(56) References Cited

U.S. PATENT DOCUMENTS

| | | | | |
|---|---|---|---|---|
| 3,450,421 A | * | 6/1969 | Harwell, Jr. | 166/355 X |
| 4,421,173 A | | 12/1983 | Beakley et al. | 166/336 |
| 4,432,420 A | * | 2/1984 | Gregory et al. | 166/355 |
| 4,449,854 A | * | 5/1984 | Nayler | 405/195.1 |
| 4,501,219 A | * | 2/1985 | Bates, Jr. | 114/264 |
| 4,934,870 A | * | 6/1990 | Petty et al. | 405/195.1 X |
| 4,962,817 A | * | 10/1990 | Jones et al. | 166/355 X |
| 5,727,630 A | * | 3/1998 | Brammer | 166/355 |
| 5,727,640 A | | 3/1998 | Gleditsch | 175/7 |

FOREIGN PATENT DOCUMENTS

| | | |
|---|---|---|
| EP | 0390728 | 10/1990 |
| GB | 1309933 | 3/1973 |
| NO | 171958 | 5/1993 |
| NO | 305138 | 4/1999 |
| NO | 306026 | 9/1999 |

* cited by examiner

*Primary Examiner*—David Bagnell
*Assistant Examiner*—Tara L. Mayo
(74) *Attorney, Agent, or Firm*—Hedman & Costigan, P.C.

(57) ABSTRACT

The present invention relates to an arrangement in a floating drilling and intervention vessel, for controlling a heave compensated drill floor 7 suspended in drill floor compensator cylinders 10. Below the compensated drill floor 7 there is installed a tidal structure (3) suspended in tidal cylinders 2 or wires 25. By adjusting the tidal cylinders 2 or the wires 25 in step with the tide 17 it is achieved that the drill floor compensator cylinders 10 can operate around their middle position regardless of the tide lifting or lowering the vessel 16.

6 Claims, 3 Drawing Sheets

ARRANGEMENT FOR CONTROLLING FLOATING DRILLING AND INTERVENTION VESSELS

FIELD OF THE INVENTION

The present invention relates to an arrangement for controlling a compensated drill floor on a floating drilling or intervention vessel, which is a vessel for carrying out well drilling, completion, workover and/or production operations at the sea. The invention acts to neutralise tidal influence on the position of the drill floor in relation to the sea bottom.

PRIOR ART

Floating drilling and intervention vessels must have some means to compensate for the heave exerted on the vessel by the sea.

Large floating drilling rigs traditionally include a telescopic coupling device in the riser/drill string. The coupling devices are placed below the drill floor, which means that the drill crew can work almost without regard to the continuously changing influence of the sea. However, the maintenance of this system is both complicated and dangerous.

Many drilling vessels have installed a system where the complete drill floor with derrick is heave-compensated. The floor is mounted on hydraulic cylinders that lift or lower the floor as needed. An example of such a system is disclosed in NO-patent 171958.

Current arrangements for drilling and well service from floating appliances have no arrangements which neutralise the influence of the tide on the drilling system. According to current techniques, all drilling and well service systems are compensated in the compensated draw works in the drilling device. The tidal effect is then adjusted by changing the position of the drill hook. Thus this operation has evident limitations with regard to the safety of the personnel and the lifetime of the coiling tubes, and it makes slim hole drilling from floating appliances difficult.

Presently there is a means of controlling a heave-compensator system by means of an active hydraulic system and accelerometer instruments. This means that the system must operate with error margins and tolerances that are unacceptable for slim hole operations and compensated drill floors.

Further reference to prior art can be found in the applicant's earlier patents: U.S. Pat. No. 5 727 640, NO 305138 and NO 306026.

SUMMARY OF THE INVENTION

An object of the present invention is to indicate an arrangement which can control a compensated drill floor and simultaneously neutralise tidal influence on the drilling systems.

This is achieved in the arrangement according to the present invention which is directed to an arrangement in a floating drilling and intervention vessel, comprising a heave-compensated drill floor suspended in drill floor compensator cylinders. The invention is characterized in that below the compensated drill floor a tidal structure and tidal cylinders are installed, so that by adjusting the tidal cylinders in step with the tide, the drill floor compensator cylinders can cycle with their full stroke regardless of the tide lifting or lowering the vessel in relation to the sea bottom.

It is preferred that below the tidal structure is connected to the compensated drill floor by one or more wires which are fastened to the compensated drill floor in one or more anchoring points. The said one or more wires run down to one or more sheaves installed on the tidal structure and further up to one or more stretch compensators, so that the drill floor compensator cylinders can cycle with their full stroke regardless of the tide lifting or lowering the vessel by controlling said one or more stretch compensators.

DESCRIPTION OF PREFERRED EMBODIMENTS

Figure 1:
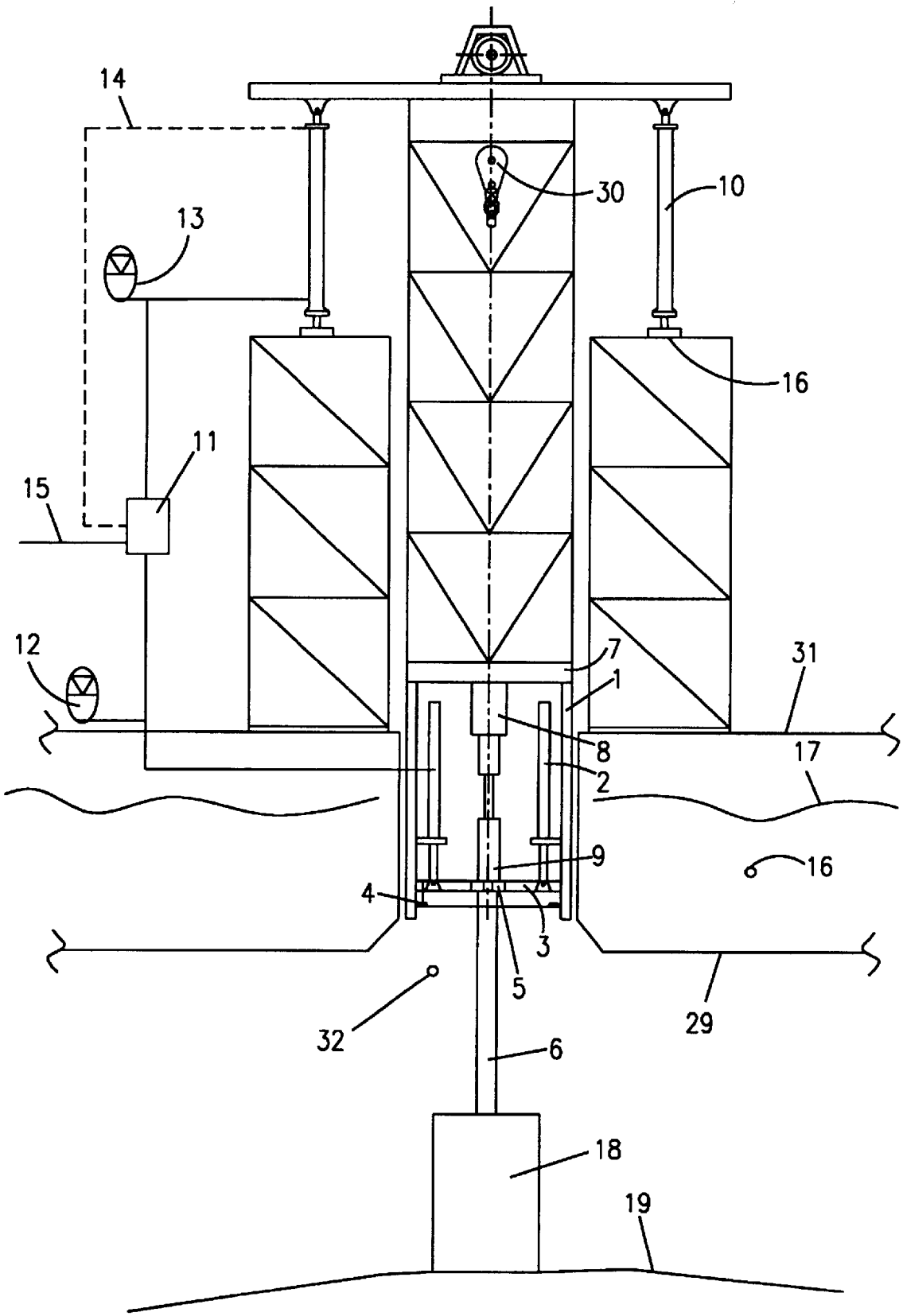
FIG. 1 shows an embodiment of an arrangement according to the invention, in particular how the tide can be neutralised by means of a frame-like structure (1) which is mounted fixed to the compensated drill floor (7). Inside this frame a tidal structure (3) is mounted which can move freely inside the frame-like structure and is positioned by means of cylinders (2) in such a way that the distance between the top of the riser pipe (6), which connects submarine safety valve (10) and the drill vessel, and drill floor can be adjusted at the same rate as the tide without influencing the drill floor compensator system. Further, the cylinders are coupled to the drill floor compensator system to act as a secondary stretch system for the riser pipe system.

FIG. 1 shows an embodiment of an arrangement according to the invention for neutralising the tidal influence on a drill floor compensator system.

The arrangement is installed in a drilling and intervention vessel 16. The vessel comprises a moon pool 32. This is an opening in the hull through which tools like a drill string etc. can be lowered into the sea. In the figure a riser pipe system 6 is shown passing through the moon pool 32 and down to the sea bottom 19. The drilling unit comprises a drill floor 7 with a derrick. At the top of the derrick the draw works are installed. The whole unit is suspended by means of hydraulic heave compensator cylinders 10. The cylinders are coupled to a hydraulic circuit, which causes the cylinders to expand and contract in unison with the movements of the vessel. In this way the rolling of the vessel is compensated, so that the drilling crew is working in a stable environment without movement caused by the surrounding seas.

The arrangement according to the invention departs from prior art in that below the compensated drill floor (7) a frame-like structure (1) is mounted with longitudinal vertical guides (4). Inside the structure (1) a structure (3) is mounted, here called a tidal structure, which can move vertically in the guides (4) by means of tidal cylinders (2). The tidal structure includes a rotational swivel (5) fixed to the riser pipe system (6). The riser pipe system (6) connects the tidal structure (3)

to the subsea safety valve (18) in such a way that an anchoring of the compensated drill floor (7) to the sea bottom is established. The drill floor compensator cylinders (10) can continuously operate around their middle position as the control valve (11) regulates the position of the tidal structure (3) as the tide (17) changes the vertical distance between the sea bottom (19) and the vessel (16). This is achieved automatically by the drill floor compensator cylinders (10) changing their middle position in step with the tide (17) and by the control signal (14) activating the control cylinder (11) for changing the position of the tidal structure (3) so the drill floor compensator cylinders (10) can compensate around their middle position at all time.

The change in vertical length between the tidal structure (3) and the compensated drill floor (7) is taken up by a telescopic tube (8) to establish a continuous tubular connection between drill floor (7) and subsea safety valve (18) independently of the movement of the tidal structure (3).

The tidal cylinders (2) are connected to an accumulator system (12) to function as a secondary stretch system for the riser pipe system (6).

Figure 2:
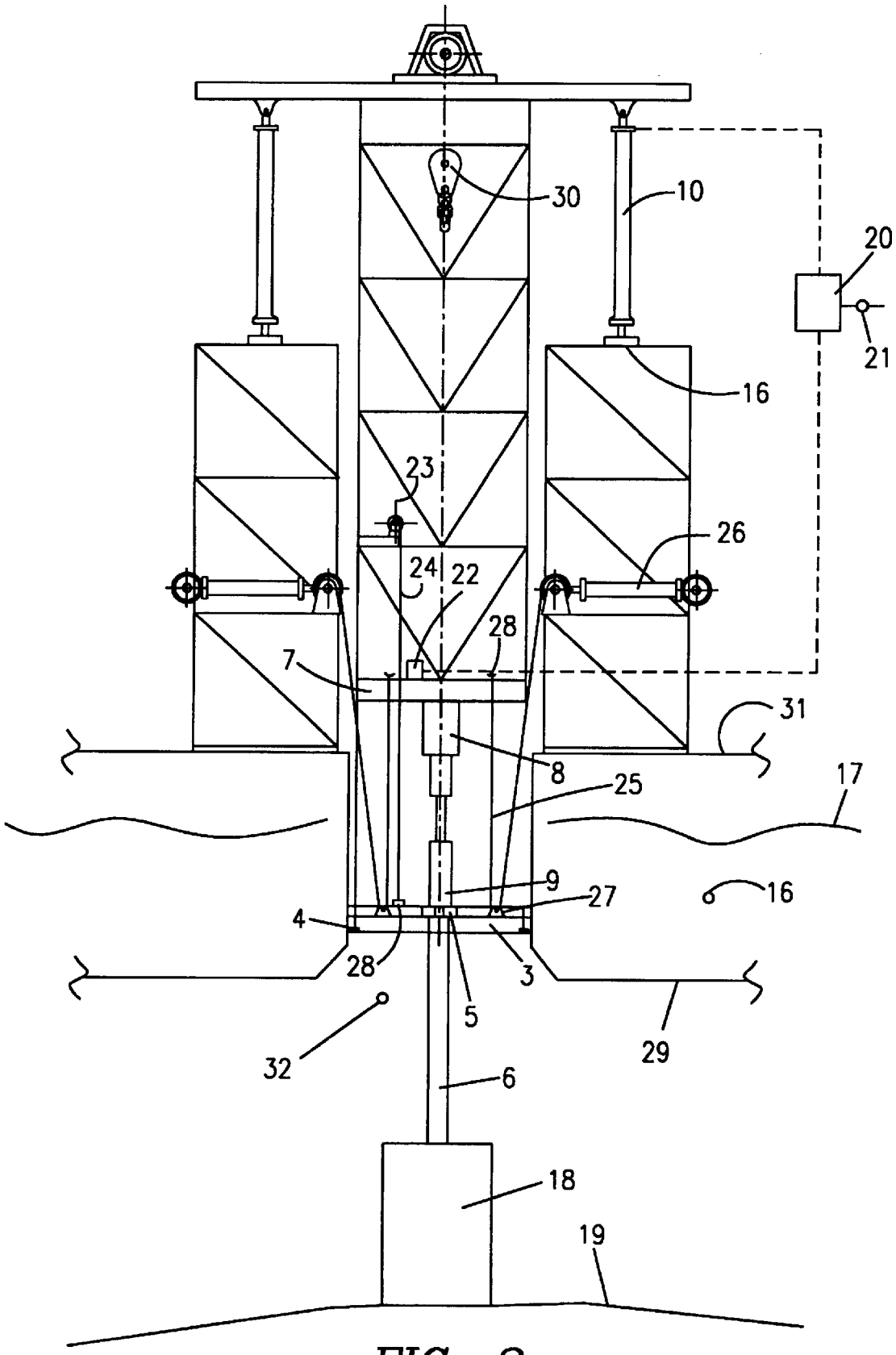
FIG. 2 shows an embodiment of an arrangement according to the invention, in particular how a tidal structure (3) is mounted below the compensated drill floor (7). The tidal structure is suspended in a complicated wire system in which one end of the wire is attached to the compensated drill floor, while the other end of the wire is attached to a riser pipe compensator (26). Normally 4 to 10 such wire systems will be mounted to a tidal structure. Further, the figure shows how control of the tidal structure is arranged to achieve a precise positioning.

In FIG. 2 an embodiment of the invention is shown, for measuring the influence of the tide on the drill floor compensator system and positioning the compensated drill floor so the drill floor compensator cylinders can operate around their middle position even if the tide changes the relative position of the vessel.

In this arrangement the frame-like structure (1) with tidal cylinders (2) is removed, and instead the tidal structure (3) is supported in the drill floor (7) in a wire system. In addition, a measuring string (24) is installed between the compensated drill floor (7) and the tidal structure (3).

The measuring string (24) is tied at one end to the tidal structure (3) in an anchoring point (28). The other end goes to a reel (23) which is installed on the compensated drill floor (7). The reel (23) maintains a constant tension in the measuring string (23) regardless of the relative movement between the compensated drill floor (7) and the tidal structure (3). The tidal structure (3) with installed rotational swivel (5) keeps the riser pipe structure (69) in constant stretch against the vessel (16). This is achieved by means of a compensated wire system in which the tidal structure (3) is suspended. The compensated wire system includes a wire (25) which in a first end is attached to the compensated drill floor (7) in an anchoring point (28). The wire (25) runs down to a sheave (27), which is fixed to the tidal structure (3). The wire runs further up to a tensioning compensator (26) which is attached to the vessel (16). The tensioning compensator (26) maintains the riser pipe system (6) in the desired stretch against the subsea safety valve (18). By arranging the wire system in this way, the necessary forces for keeping the riser pipe system (6) in tension are distributed equally among the drill floor compensator cylinders (10) and the tensioning compensators (26).

The measuring string (23) will output a continuous measuring signal to the position gauge (22) which is installed on the compensated drill floor (7). The position gauge (22) will output an immediate and precise control signal to the control valve (20), whereby an adjustment of the drill floor compensator cylinders (10) can be made to keep the distance between the compensated drill floor (7) and the tidal structure (3) constant at all times, regardless of the movements of the vessel (16).

Figure 3B:
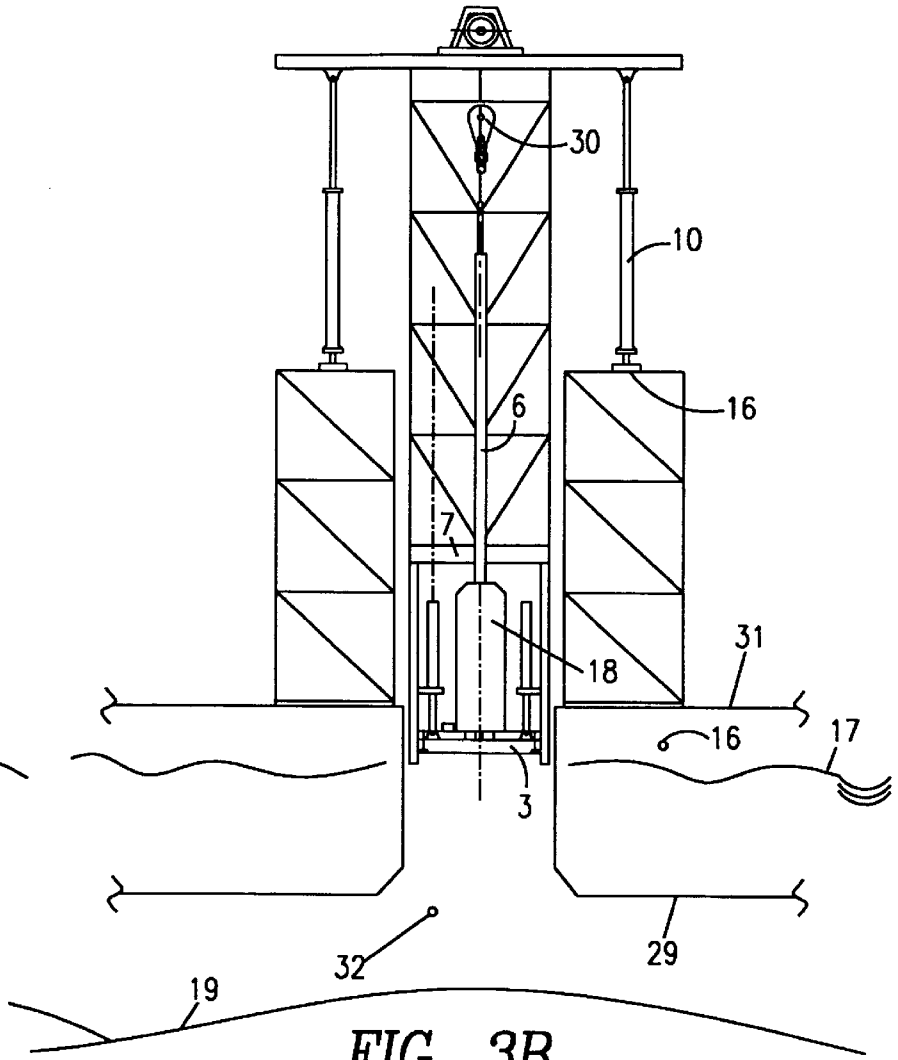
FIGS. 3A and 3B show an embodiment of an arrangement according to the invention, in particular how the tidal structure (3) can be employed as a lift for subsea modules so that the modules can be safely lifted into the vessel even if it is moving in a fashion which would otherwise prohibit such a lifting operation.
Figure 3A:
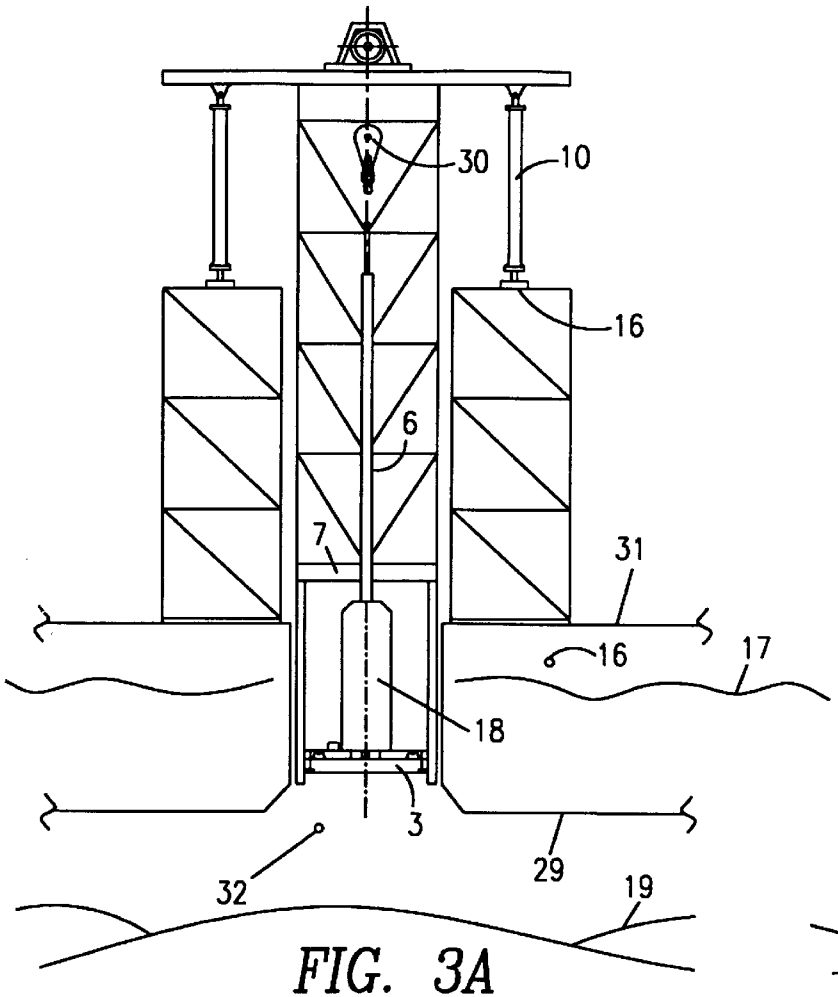

FIGS. 3A and 3B show how an arrangement according to the invention is used in real time for retrieving and lowering subsea modules through the vessel's moon pool (32).

The tidal structure (3) is arranged to have a position level with the vessel's deck (31) when the compensated drill floor (7) is in its upper position, shown in FIG. 3B, with the drill floor compensator cylinders (10) at maximum length of stroke. The subsea safety valve (18) is placed inside the tidal structure (3) and connected to the riser pipe system (6). The tidal floor (3) is lowered by means of the drill floor compensator cylinders (10) to its lower position, shown in FIG. 3A, which is arranged so that the tidal structure is level with the vessel's bottom (29). By using the arrangement depicted in FIGS. 3A and 3B, subsea modules can be lifted and lowered through the vessel even if this is rolling. Having to wait for good weather at such lifting operations is avoided. The safety valve (18) is docked to the tidal structure (3) and licked to this to enable it to be lifted onto the vessel's deck by means of the drill floor compensator cylinders (10).

What is claimed is:

1. An arrangement in a floating drilling and intervention vessel, comprising a heave-compensated drill floor suspended in drill floor compensator cylinders, characterized in that below the compensated drill floor (7) a tidal structure (3) and tidal cylinders (2) are installed, so that by adjusting the tidal cylinders (2) in step with the tide (17), the drill floor compensator cylinders (10) can cycle with their full stroke regardless of the tide lifting or lowering the vessel (16) in relation to the sea bottom.

2. The arrangement as claimed in claim 1, characterized in that the tidal structure (3) is arranged with a rotational swivel (5) for attachment against a riser pipe system (6).

3. The arrangement as claimed in claim 2, characterized in that a telescopic section (8) is installed in the riser pipe system (6) between the tidal structure (3) and surface safety valve (9).

4. A method for using the arrangement as claimed in claim 1 as a lift for lowering or lifting a subsea module through a "moon pool" (32) in the vessel (16), comprising placing said module inside the tidal structure (3) and lifting or lowering the compensated drill floor (7) by means of the drill floor compensator cylinders (10) in order to lift or lower said module, regardless of the movements of the vessel (16).

5. An arrangement in a floating drilling and intervention vessel, for controlling a heave-compensated drill floor suspended in drill floor compensator cylinders, characterized in that below the compensated drill floor (7) a tidal structure (3) is installed which is connected to the compensated drill floor (7) by one or more wires (25) which are fastened to the compensated drill floor (7) in one or more anchoring points (28), and said one or more wires (25) run down to one or more sheaves (27) installed on the tidal structure (3) and further up to one or more stretch compensators (26), so that by controlling said one or more stretch compensators (26) in step with the tide, the drill floor compensator cylinders (10) can cycle with their full stroke regardless of the tide lifting or lowering the vessel (16) in relation to the sea bottom.

6. The arrangement as claimed in claim 5, characterized in that between the compensated drill floor (7) and the tidal structure (3) a measuring string (24) is installed, and in that on the compensated drill floor (7) a position gauge (22) is installed for controlling the drill floor compensator cylinders (10) such that the distance between the tidal structure (3) and the compensated drill floor (7) is constant, regardless of the movements of the vessel (16).

* * * * *